US011484745B1

(12) United States Patent
Weng

(10) Patent No.: US 11,484,745 B1
(45) Date of Patent: Nov. 1, 2022

(54) WEIGHT ADJUSTABLE DUMBBELL

(71) Applicant: Zhejiang Qili Health Technology Ltd., Zhejiang (CN)

(72) Inventor: Gaowang Weng, Zhejiang (CN)

(73) Assignee: Zhejiang Qili Health Technology Ltd., Jinhua (CN)

( * ) Notice: Subject to any disclaimer, the term of this patent is extended or adjusted under 35 U.S.C. 154(b) by 0 days.

(21) Appl. No.: 17/580,208

(22) Filed: Jan. 20, 2022

(30) Foreign Application Priority Data

Apr. 12, 2021 (CN) ..... 202110386583.6
Apr. 12, 2021 (CN) ..... 202110386692.8
Apr. 12, 2021 (CN) ..... 202120730112.8
Apr. 12, 2021 (CN) ..... 202120755516.2

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
CPC .... A63B 21/072–075; A63B 21/00058–00065
See application file for complete search history.

(56) References Cited

U.S. PATENT DOCUMENTS 11,167,167 B1 * 11/2021 Weng ..... A63B 21/0726
2007/0184945 A1 * 8/2007 Lin ..... A63B 21/075 482/107
2008/0070761 A1 * 3/2008 Lin ..... A63B 21/075 482/107
2009/0305852 A1 * 12/2009 Hoglund ..... A63B 21/0728 482/107
2010/0323856 A1 * 12/2010 Svenberg ..... A63B 21/075 482/108
2022/0096890 A1 * 3/2022 Lu ..... A63B 21/0728

* cited by examiner

*Primary Examiner* — Garrett K Atkinson
*Assistant Examiner* — Kathleen M Fisk
(74) *Attorney, Agent, or Firm* — Dragon Sun Law Firm, PC; Jinggao Li; Nathaniel Perkins

(57) ABSTRACT

The present invention discloses a weight adjustable dumbbell, which includes a dumbbell assembly, a dumbbell seat and a plurality of dumbbell pieces placed on two sides of the dumbbell seat, wherein the dumbbell assembly includes a handle tube, tailstock assemblies provided on two sides of the handle tube, a fixed shaft provided throughout inside the handle tube and the tailstock assembly and two telescopic tubes symmetrically sleeved outside the fixed shaft, wherein the handle tube is rotatably connected between the two tailstock assemblies, the handle tube is a hollow tube pieces, with an inner wall thereof being provided with two guide grooves with opposite screw directions, one end of the telescopic tube close to the center of the handle tube is provided with a guide block, and the other end thereof is symmetrically provided with an anti-rotation block , the tailstock assembly includes a tailstock body.

10 Claims, 11 Drawing Sheets

WEIGHT ADJUSTABLE DUMBBELL

CROSS-REFERENCE TO RELATED APPLICATIONS

The present application is based on, and claims priority from, Chinese applications numbered: CN202120730112.8, filed Dec. 29, 2021, CN202110386583.6, filed December 29, 2021, CN202110386692.8, filed Dec. 29, 2021, and CN202120755516.2, filed Dec. 29, 2021; the disclosure of which is hereby incorporated by reference herein in its entirety.

TECHNICAL FIELD

The present invention relates to the technical field of fitness equipment, and in particular to a weight adjustable dumbbell.

BACKGROUND

Dumbbell is a common and simple fitness equipment, which is mainly used for users' hands to grasp and strengthen their arms.

However, the old type dumbbells are integrally formed, and thus cannot change the counterweight, resulting in the problems that users have to buy a plurality of dumbbells with different weights when they want to use dumbbells with different weights, which may cost too much and the quantity is too much to accommodate.

SUMMARY

The present invention is intended to provide a weight-adjustable dumbbell to solve the technical problems that the old type dumbbells mentioned in the background art are integrally formed, so that the counterweight cannot be changed, and when users want to use dumbbells with different weights, they have to buy a plurality of dumbbells with different weights, and the cost is too high and the quantity is too large to be accommodated.

In order to achieve the above objectives, the present invention provides the following technical solutions: a weight adjustable dumbbell, comprising a dumbbell assembly, a dumbbell seat and a plurality of dumbbell pieces placed on two sides of the dumbbell seat, which is characterized in that the dumbbell assembly comprises a handle tube, tailstock assemblies provided on two sides of the handle tube, a fixed shaft provided throughout inside the handle tube and the tailstock assembly and two telescopic tubes symmetrically sleeved outside the fixed shaft, wherein the handle tube is rotatably connected between the two tailstock assemblies, the handle tube is a hollow tube pieces, with an inner wall thereof being provided with two guide grooves with opposite screw directions, one end of the telescopic tube close to the center of the handle tube is provided with a guide block, and the other end thereof is symmetrically provided with an anti-rotation block, the tailstock assembly comprises a tailstock body, an anti-rotation groove is provided in the tailstock body, the anti-rotation block is installed in the anti-rotation groove, the guide block is mounted in the guide groove in a sliding manner, and rotating the handle tube can drive the telescopic tube to slip in the anti-rotation groove , the dumbbell piece is detachably mounted on the tailstock body , the middle portion of the dumbbell piece is provided with a fixing hole into which the telescopic tube is inserted, and the upper end of the fixing hole is provided with an open groove communicated therewith, the width of the open groove is smaller than the diameter of the telescopic tube, the width of the open groove is larger than the diameter of the fixed shaft, with the forward or reverse rotation of the handle tube, during the process of the guide block travels along the guide groove, the two telescopic tubes can extend out or retract into the handle tube, and when the telescopic tubes extend out of the handle and enter the tailstock body, the dumbbell pieces can be loaded or unloaded in sequence with the rotation of the handle tube.

Preferably, the tailstock assembly further comprises a tailstock inner cover and a tailstock outer cover, which are provided on two sides of the tailstock body, wherein a counterweight block is further mounted on the tailstock outer cover, the counterweight block, the tailstock outer cover, the tailstock body and the tailstock inner cover are fixedly connected by means of long bolts, an outer side of the tailstock inner cover is clamped to a dumbbell inner cover, an outer side of the tailstock outer cover is clamped to a dumbbell outer cover, and an upper end of the tailstock body is clamped to an upper end cover.

Preferably, the dumbbell assembly is further provided with a locking mechanism, which comprises a limiting ring and a limiting block, which is mounted between the dumbbell inner cover and the tailstock inner cover, wherein the limiting ring is sleeved at an end of the handle tube and can provide, with the rotation of the handle tube, a plurality of limiting protruding bars at an outer edge of the limiting ring, two adjacent limiting protruding bars do not come into contact with each other and form a limiting block channel, and a hooking portion protrudes from the top portion of the limiting block, when the limiting block is initially affected by gravity, the hooking portion is located in the limiting block channel, so as to lock limiting protruding bars on two sides to limit the rotation of the handle tube relative to the tailstock assembly, after the limiting block is jacked up, the hooking portion separates from the limiting block channel.

Preferably, the bottom of the dumbbell inner cover is provided with a pin hole, and two front baffles are provided above the pin hole, the tailstock inner cover is provided with rear baffles at a position corresponding to the front baffles, a limiting groove for accommodating the limiting block is formed between the front baffles and the rear baffles, a supporting plate is further provided in the limiting groove, one side of the limiting block is provided with two clamping blocks, one of the two clamping blocks is above the supporting plate and the other is below the supporting plate, and when the upper clamping block falls on the supporting plate, the hooking portion of the limiting block is located inside the limiting block channel, and a locking spring is further mounted between the lower clamping block and the supporting plate.

Preferably, two pins are provided, in a protruding manner, on the dumbbell seat which is corresponding to the bottom of the pin hole, when the dumbbell assembly is placed on the dumbbell seat, the pins jack up the limiting block and make the hooking portion protruding from the top of the limiting block leave the limiting block channel Preferably, the dumbbell assembly is further provided with a weight display mechanism, which comprises a main gear fixedly mounted at the end of the handle tube and a scale gear mounted between the dumbbell inner cover and the tailstock inner cover, wherein the scale gear and the main gear are meshed, and a back face of the scale gear is provided with a gear scale, a scale window is further provided on the dumbbell inner cover, two ends of a central shaft of the scale gear extend outwards to form a mounting shaft, and a mounting hole for inserting the mounting shaft is provided between the dumbbell inner cover and the tailstock inner cover at a position corresponding to the mounting shaft.

Preferably, at least two pin holes are symmetrically provided at an inner side of tailstock inner cover, positioning thimbles are mounted inside the pin holes, thimble springs are mounted between the positioning thimbles and the pin holes, the plurality of pin holes are located on the same circumference, a plurality of positioning holes are uniformly distributed at an inner side of the scale gear, the diameter of the plurality of pin holes is the same as that of the positioning holes, and when the gear scale is directly in the position of the scale window, the positioning thimbles can be inserted into the positioning hole.

Preferably, an outer wall of the tailstock body is provided with a limiting ridge for blocking two adjacent dumbbell pieces.

Preferably, slits are provided at two ends of the fixed shaft, and a pin hole is provided in the middle of the counterweight block, wherein the shapes of the pin hole is matched with the slits, and the fixed shaft is restricted from rotating by means of the cooperation of the slits and the pin hole.

Preferably, a plurality of plug blocks are uniformly provided at two ends of the handle tube, and slots for inserting the plug blocks are provided on inner rings of the limiting ring and the main gear, such that the limiting ring and the main gear can rotate synchronously with the handle tube.

Compared with the prior art, the beneficial effect of the present invention is that:

According to the weight adjustable dumbbell, a guide groove is provided in the handle tube, a guide block at one end of the telescopic tube is mounted in the guide groove, the anti-rotation block at the other end of the telescopic tube is provided in the anti-rotation groove, the telescopic tube cannot rotate, when the handle tube is rotated, the guide groove in the handle tube can pull the telescopic tube to move to the left or right, and after the telescopic tube moves towards the handle, the dumbbell piece can be detached because the width of the opening groove of the dumbbell piece is larger than the outer diameter of the fixed shaft. When the telescopic tube moves away from the handle, the telescopic tube moves into the fixing hole of the dumbbell piece. Because the width of the opening groove of the dumbbell piece is smaller than the diameter of the telescopic tube, the dumbbell piece can be fixed on the tailstock assembly, so as to complete the disassembly or installation operation of the dumbbell piece. According to the invention, the dumbbell pieces can be loaded and unloaded only by rotating the handle tube, and the dumbbell pieces do not need to be moved additionally, such that the operation is convenient, and the handle can only be rotated when the dumbbell is placed on the base. When the dumbbell leaves the base, the limiting block will fall under the force of gravity or the locking spring, and the hooking portion of the limiting block will block the limiting ring to make the handle tube unable to rotate, with high safety.

Figure 1:
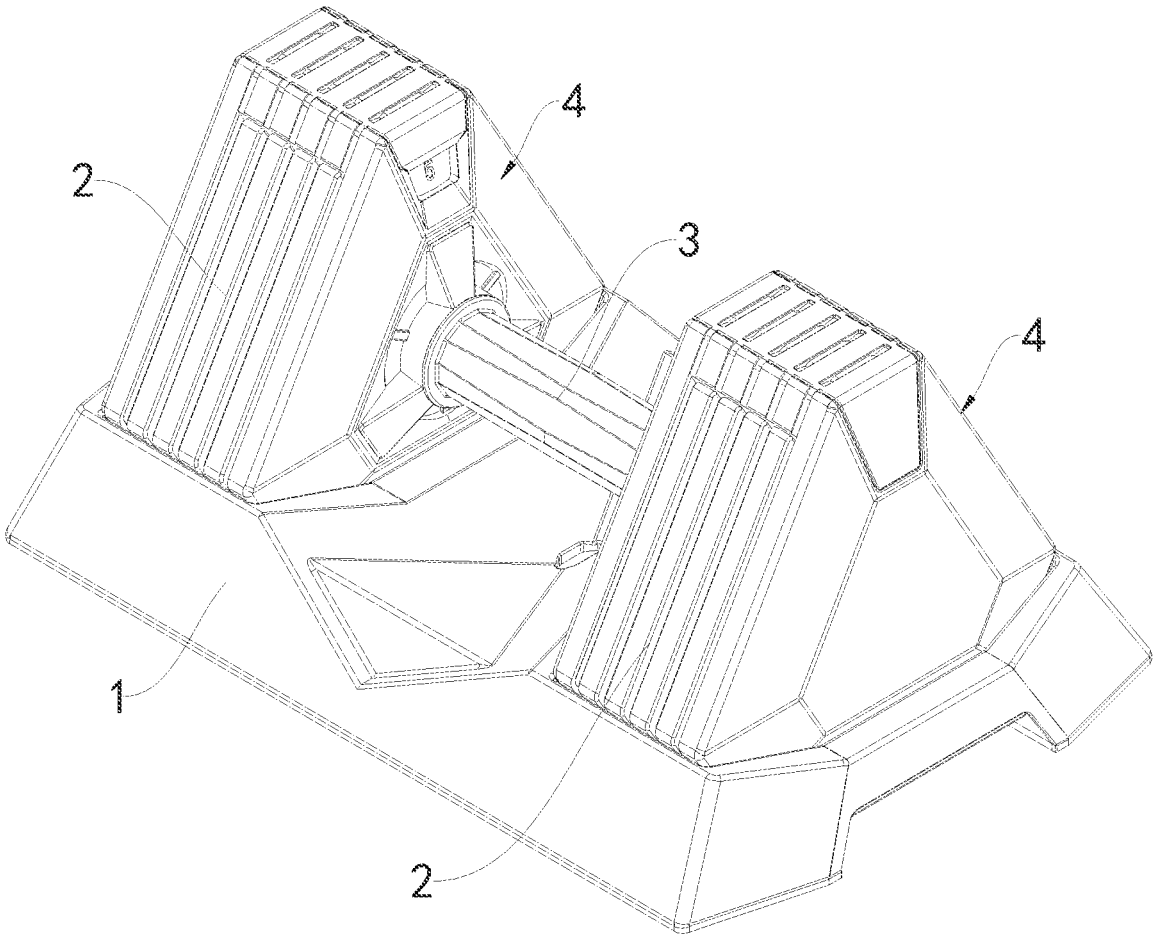
FIG. 1 is a schematic structural diagram of the overall of the present invention.
Figure 2:
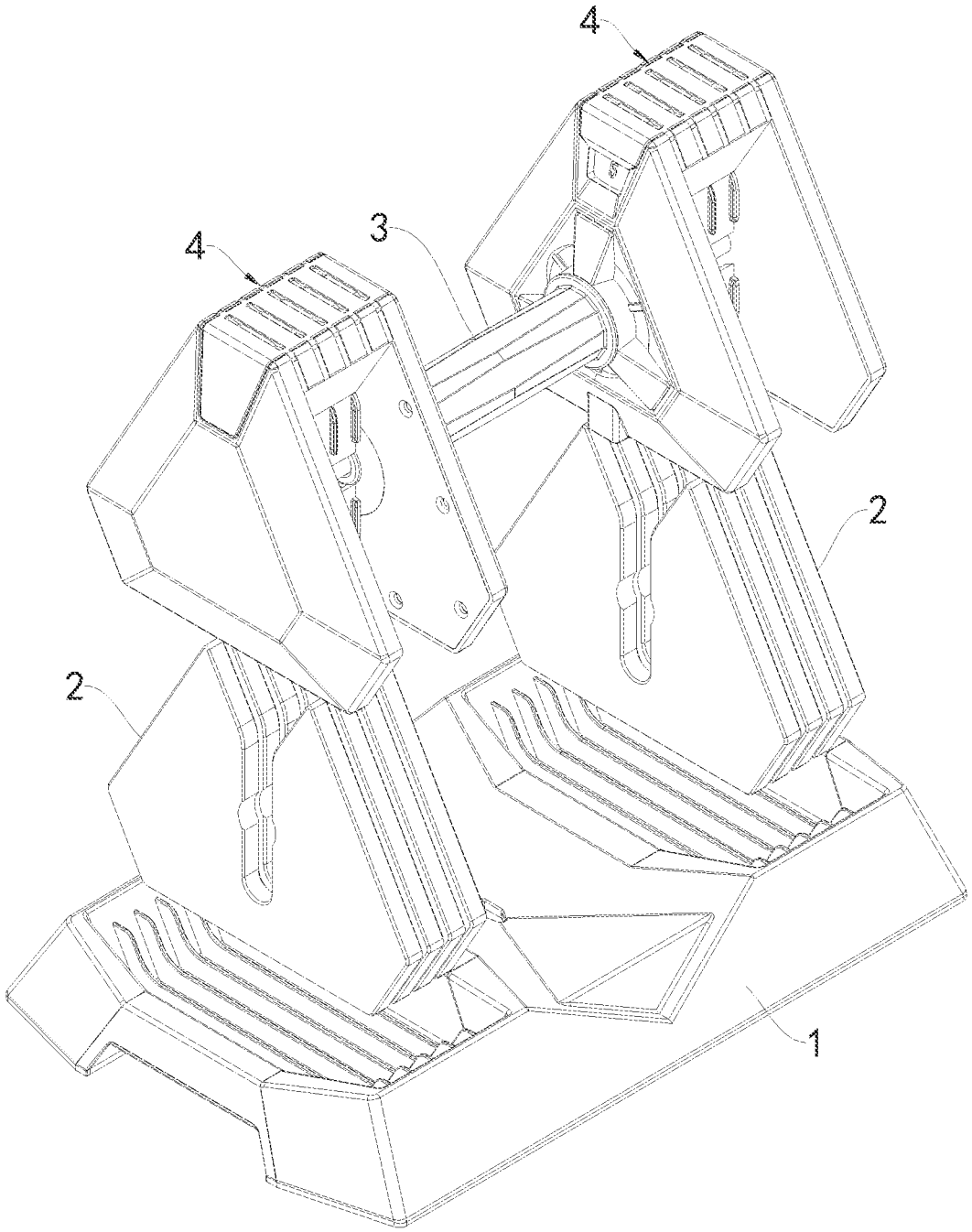
FIG. 2 is a schematic structural diagram of the overall explosion of the present invention.
Figure 3:
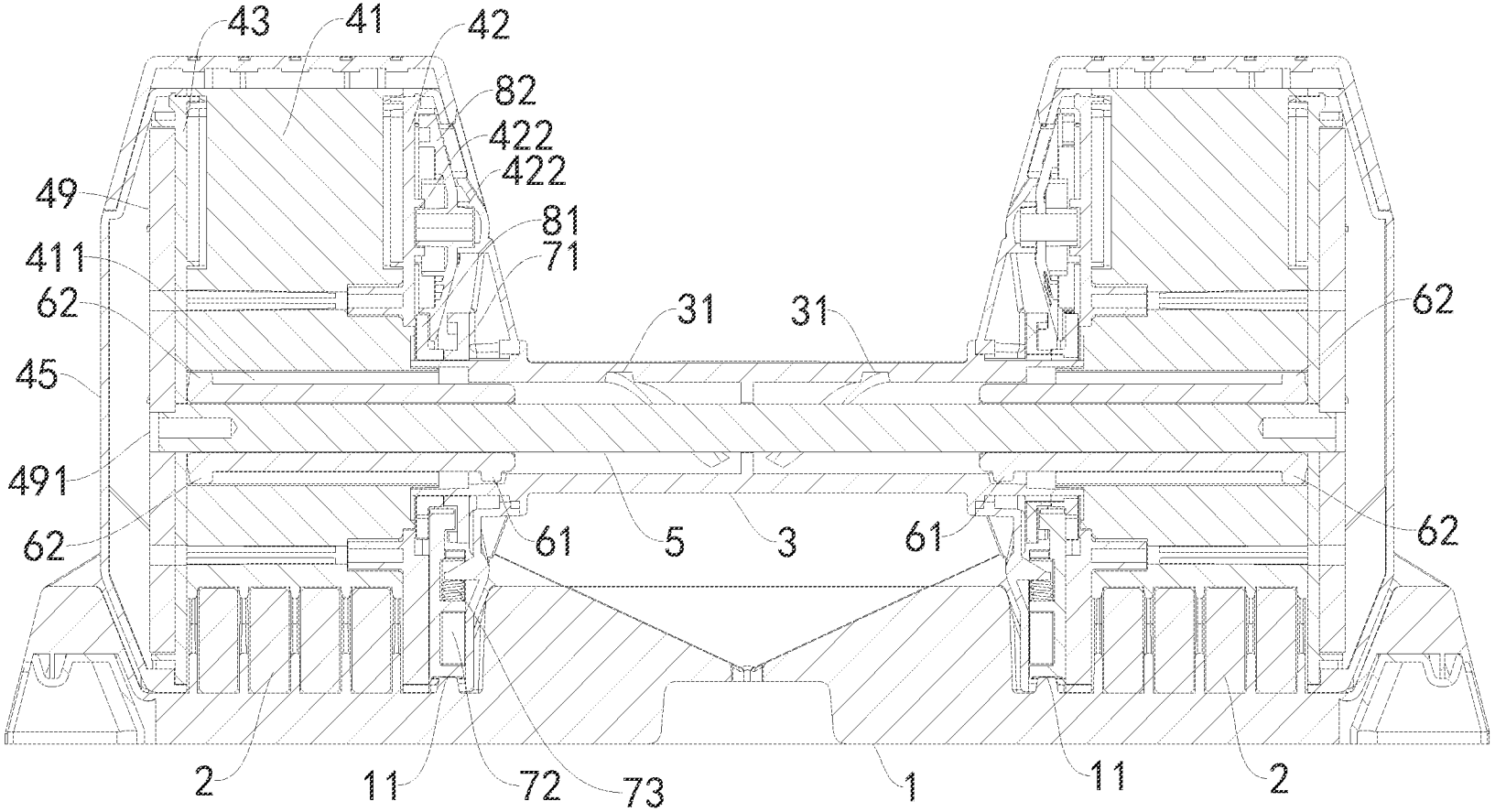
FIG. 3 is an overall cross-sectional view of the present invention.

In the drawings: 1. dumbbell seat; 11. pin; 2. dumbbell piece; 21. fixing hole; 22. open groove; 3. handle tube; 31. guide groove; 32. plug block; 4. tailstock assembly; 41. tailstock body; 411. anti-rotation groove; 412. limiting ridge; 42. tailstock inner cover; 421. rear baffle; 422. mounting hole; 423. pin hole; 43. tailstock outer cover; 44. dumbbell inner cover; 441. pin hole; 442. front baffle; 443. limiting groove; 444. supporting plate; 445. scale window; 45. dumbbell outer cover; 46. upper end cover; 47. positioning thimble; 48. thimble spring; 49. counterweight block; 491. pin hole; 5. fixed shaft; 51. slit; 6. telescopic tube; 61. guide block; 62. anti-rotation block; 71. limiting ring; 711. limiting protruding bar; 712. limiting block channel; 72. limiting block; 721. hooking portion; 722. clamping block; 73. locking spring; 81. main gear; 811. slot; 82. scale gear; 821. gear scale; 822. mounting shaft; 823. positioning hole.

DETAINED DESCRIPTION

With reference to the drawings in the embodiments of the present invention, the technical solutions in the embodiments of the present invention will be clearly and completely described. Obviously, the described embodiments are only part of the embodiments of the present invention, not all of the embodiments. On the basis of the embodiments in the present invention, all other embodiments obtained by a person of ordinary skill in the art without creative efforts shall fall within the protection scope of the present invention.

Referring to FIGS. 1-13, the present invention provides a technical solution: a weight adjustable dumbbell, comprising a dumbbell assembly, a dumbbell seat 1 and a plurality of dumbbell pieces 2 placed on two sides of the dumbbell seat 1, which is characterized in that the dumbbell assembly comprises a handle tube 3, tailstock assemblies 4 provided on two sides of the handle tube 3, a fixed shaft 5 provided throughout inside the handle tube 3 and the tailstock assembly 4 and two telescopic tubes 6 symmetrically sleeved outside the fixed shaft 5, wherein the handle tube 3 is rotatably connected between the two tailstock assemblies 4, the handle tube 3 is a hollow tube pieces, with an inner wall thereof being provided with two guide grooves 31 with opposite screw directions, one end of the telescopic tube 6 close to the center of the handle tube 3 is provided with a guide block 61, and the other end thereof is symmetrically provided with an anti-rotation block 62, the tailstock assembly 4 comprises a tailstock body 41, an anti-rotation groove 411 is provided in the tailstock body 41, the anti-rotation block 62 is installed in the anti-rotation groove 411, the guide block 61 is mounted in the guide groove 31 in a sliding manner, and rotating the handle tube 3 can drive the telescopic tube 6 to slip in the anti-rotation groove 411, the dumbbell piece 2 is detachably mounted on the tailstock body 41, the middle portion of the dumbbell piece 2 is provided with a fixing hole 21 into which the telescopic tube 6 is inserted, and the upper end of the fixing hole 21 is provided with an open groove 22 communicated therewith, the width of the open groove 22 is smaller than the diameter of the telescopic tube 6, the width of the open groove 22 is larger than the diameter of the fixed shaft 5, with the forward or reverse rotation of the handle tube 3, during the process of the guide block 61 travels along the guide groove 31, the two telescopic tubes 6 can extend out or retract into the handle tube 3, and when the telescopic tubes 6 extend out of the handle and enter the tailstock body 41, the dumbbell pieces 2 can be loaded or unloaded in sequence with the rotation of the handle tube 3, a guide groove is provided in the handle tube, a guide block at one end of the telescopic tube is mounted in the guide groove, the anti-rotation block at the other end of the telescopic tube is provided in the anti-rotation groove, the telescopic tube cannot rotate, when the handle tube is rotated, the guide groove in the handle tube can pull the telescopic tube to move to the left or right, and after the telescopic tube moves towards the handle, the dumbbell piece can be detached because the width of the opening groove of the dumbbell piece is larger than the outer diameter of the fixed shaft. When the telescopic tube moves away from the handle, the telescopic tube moves into the fixing hole of the dumbbell piece. Because the width of the opening groove of the dumbbell piece is smaller than the diameter of the telescopic tube, the dumbbell piece can be fixed on the tailstock assembly, so as to complete the disassembly or installation operation of the dumbbell piece. According to the invention, the dumbbell pieces can be loaded and unloaded only by rotating the handle tube, and the dumbbell pieces do not need to be moved additionally, such that the operation is convenient, and the handle can only be rotated when the dumbbell is placed on the base. When the dumbbell leaves the base, the limiting block will fall under the force of gravity or the locking spring, and the hooking portion of the limiting block will block the limiting ring to make the handle tube unable to rotate, with high safety.

Figure 4:
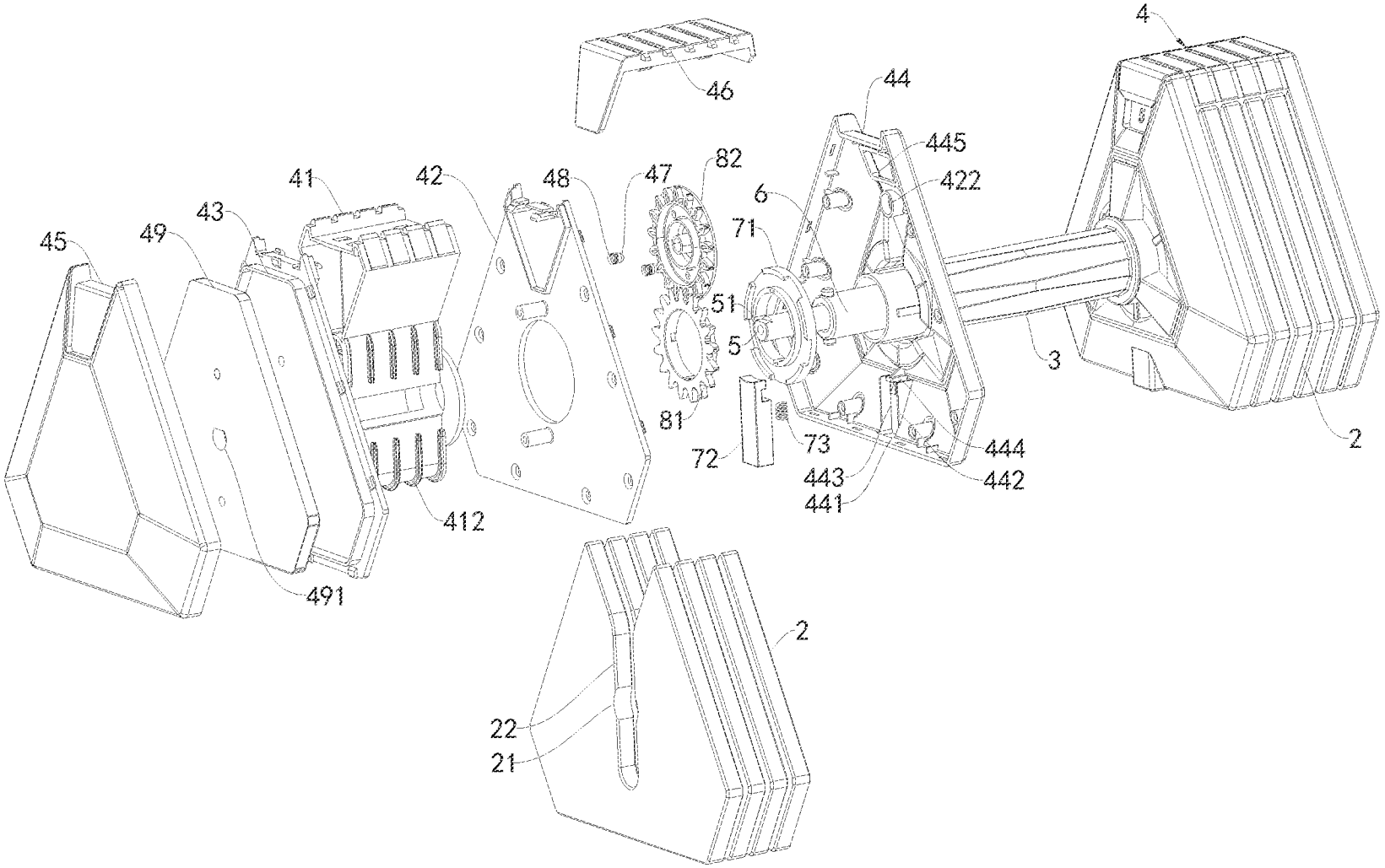
FIG. 4 is a schematic structural diagram of the overall explosion of the present invention.

As shown in FIG. 4, the tailstock assembly 4 further comprises a tailstock inner cover 42 and a tailstock outer cover 43, which are provided on two sides of the tailstock body 41, wherein a counterweight block 49 is further mounted on the tailstock outer cover 43, the counterweight block 49, the tailstock outer cover 43, the tailstock body 41 and the tailstock inner cover 42 are fixedly connected by means of long bolts, an outer side of the tailstock inner cover 42 is clamped to a dumbbell inner cover 44, an outer side of the tailstock outer cover 43 is clamped to a dumbbell outer cover 45, and an upper end of the tailstock body 41 is clamped to an upper end cover 46, the providing of the counterweight 49 can ensure that when all dumbbell pieces are removed, the unloaded dumbbell assembly further has a certain weight. In this case, the weight of the dumbbell is 5 KG in the unloaded state.

Figure 5:
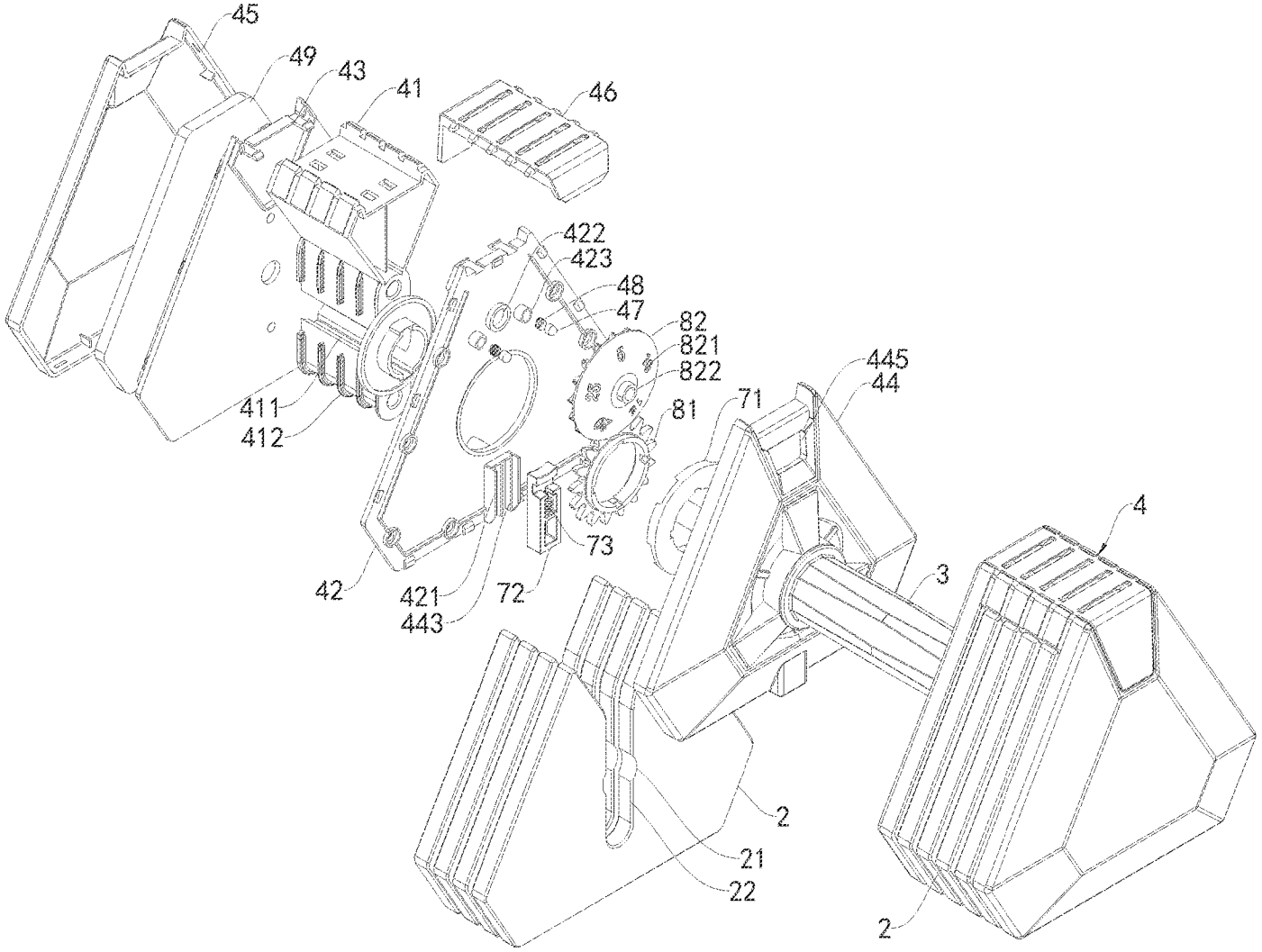
FIG. 5 is a schematic structural diagram of the overall explosion of the present invention.
Figure 6:
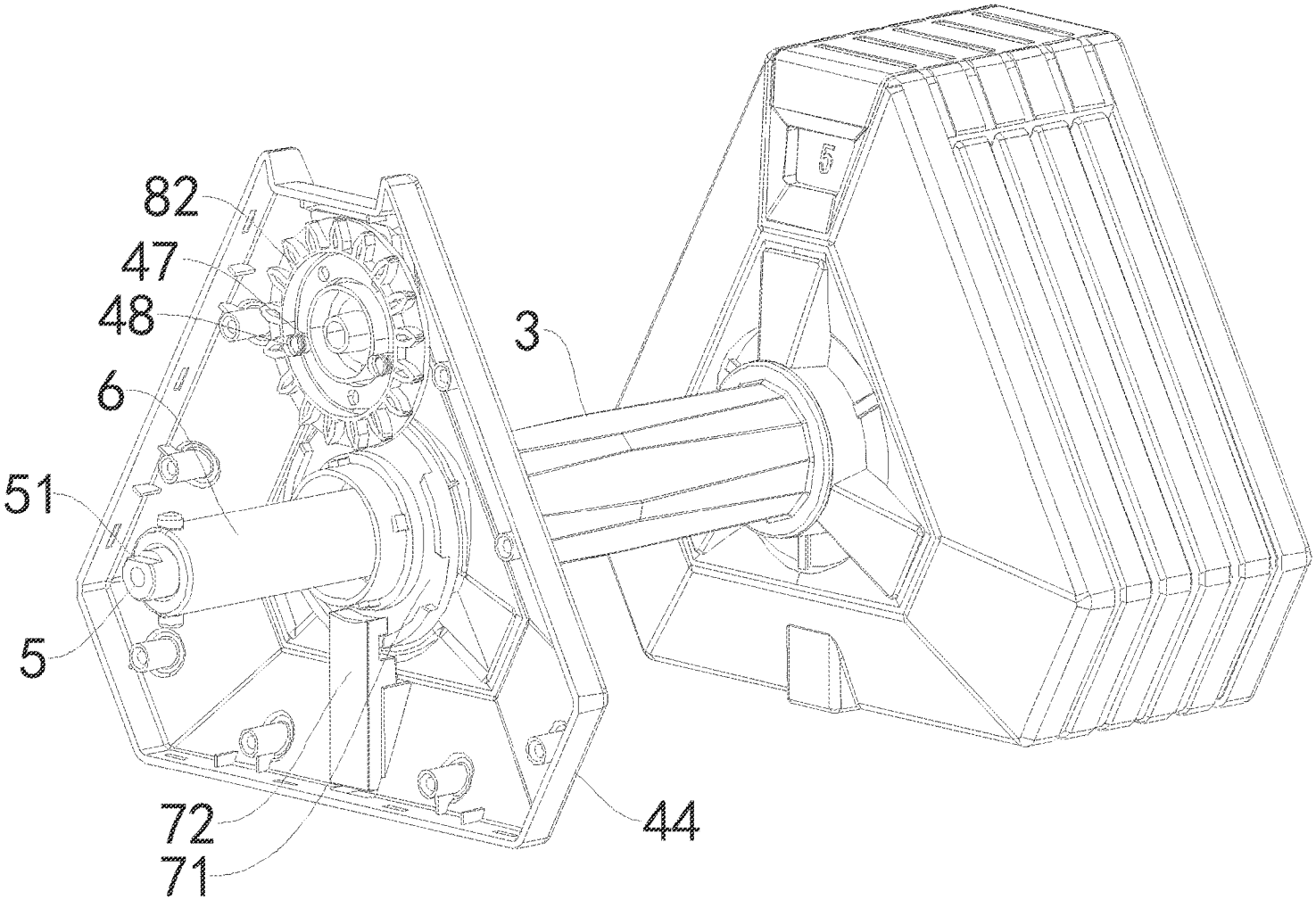
FIG. 6 is a schematic structural diagram of parts omitted in the present invention.
Figure 10:
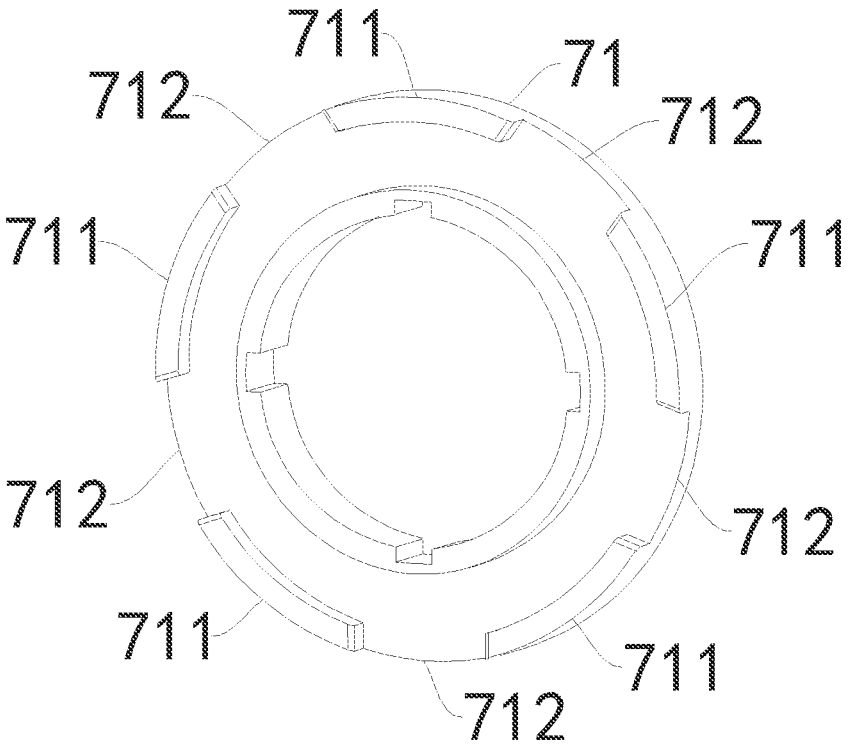
FIG. 10 is a schematic structural diagram of the limiting ring of the present invention.
Figure 11:
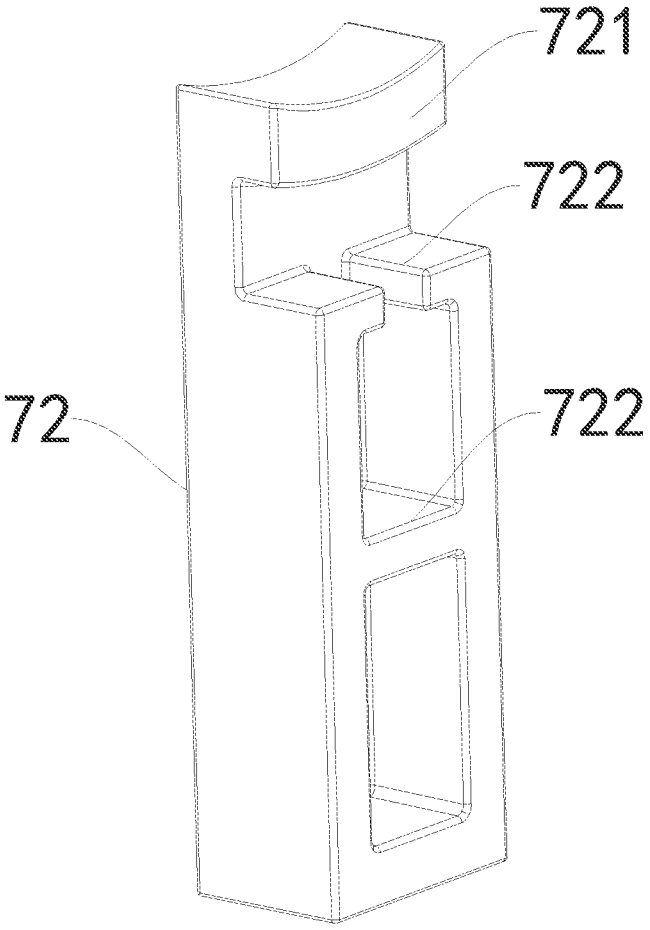
FIG. 11 is a schematic structural diagram of the limiting block of the present invention.
Figure 12:
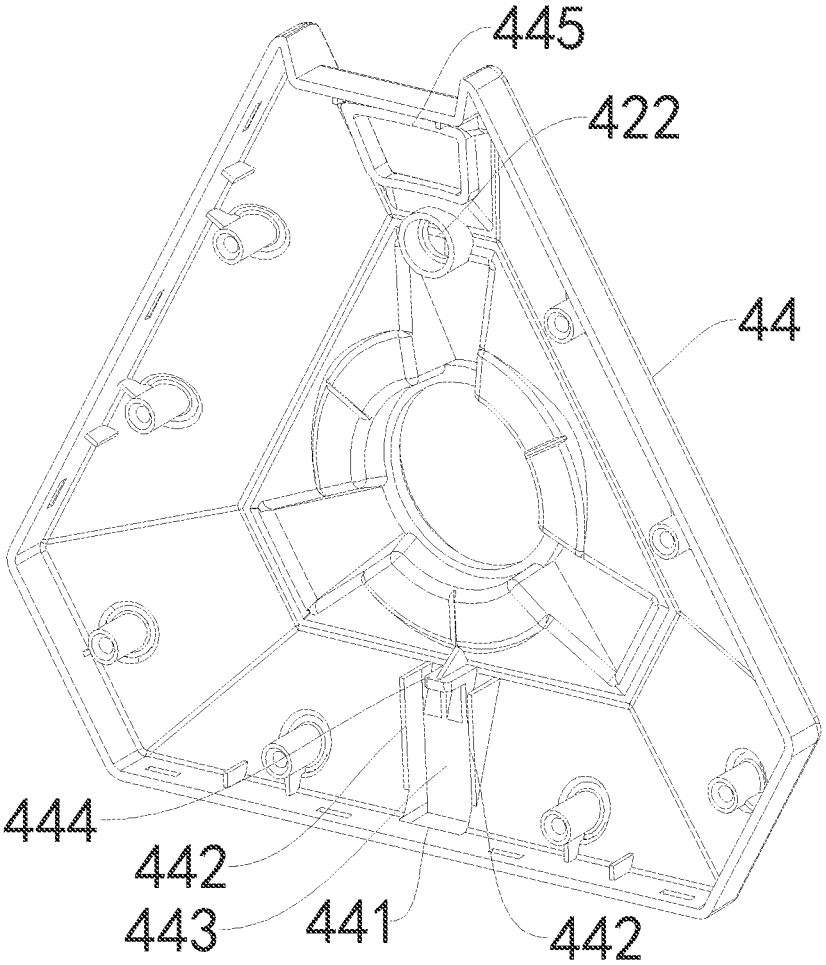
FIG. 12 is a schematic structural diagram of the dumbbell inner cover of the present invention.
Figure 13:
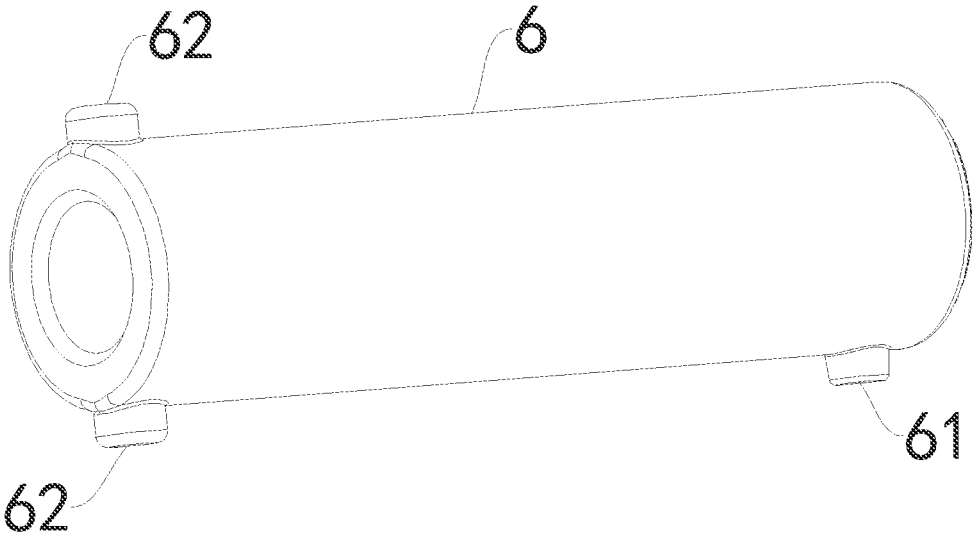
FIG. 13 is a schematic structural diagram of the telescopic tube of the present invention.

As shown in FIGS. 5, 10 and 11, the dumbbell assembly is further provided with a locking mechanism, which comprises a limiting ring 71 and a limiting block 72 which is mounted between the dumbbell inner cover 44 and the tailstock inner cover 42, wherein the limiting ring 71 is sleeved at an end of the handle tube 3 and can provide, with the rotation of the handle tube 3, a plurality of limiting protruding bars 711 at an outer edge of the limiting ring 71, two adjacent limiting protruding bars 711 do not come into contact with each other and form a limiting block channel 712, and a hooking portion 721 protrudes from the top portion of the limiting block 72, when the limiting block 72 is initially affected by gravity, the hooking portion 721 is located in the limiting block channel 712, so as to lock limiting protruding bars 711 on two sides to limit the rotation of the handle tube 3 relative to the tailstock assembly 4, after the limiting block 72 is jacked up, the hooking portion 721 separates from the limiting block channel 712, as shown in FIGS. 6 and 12, the bottom of the dumbbell inner cover 44 is provided with a pin hole 441, and two front baffles 442 are provided above the pin hole 441, the tailstock inner cover 42 is provided with rear baffles 421 at a position corresponding to the front baffles 442, a limiting groove 443 for accommodating the limiting block 72 is formed between the front baffles 442 and the rear baffles 421, a supporting plate 444 is further provided in the limiting groove 443, one side of the limiting block 72 is provided with two clamping blocks 722, one of the two clamping blocks 722 is above the supporting plate 444 and the other is below the supporting plate 444, and when the upper clamping block 722 falls on the supporting plate 444, the hooking portion 721 of the limiting block 72 is located inside the limiting block channel 712, and a locking spring 73 is further mounted between the lower clamping block 722 and the supporting plate 444, when using the dumbbell, the limiting block 72 mounted in the limiting groove 443 makes the hooking portion 721 of the limiting block 72 locate in the limiting block channel 712 under the action of the locking spring 73. in this case, the limiting ring 71 is restricted by the limiting block 72 and cannot rotate. Because the limiting ring 71 is fixedly connected with the handle tube, the handle tube cannot rotate, thus preventing the dumbbell from falling off during use. Because two pins 11 protrude from the bottom of the corresponding pin hole 441 on the dumbbell seat 1, when the dumbbell assembly is placed on the dumbbell seat 1, the pins 11 will jack up the limiting block 72 and make the hooking portion 721 protruding from the top of the limiting block 72 leave the limiting block channel 712, and the restriction of the limiting ring 71 will be released, so the handle tube can be rotated to adjust the position of the telescopic tube 6, so as to load or unload the dumbbell pieces.

As shown in FIGS. 3-6 and 9, the dumbbell assembly is further provided with a weight display mechanism, which comprises a main gear 81 fixedly mounted at the end of the handle tube 3 and a scale gear 82 mounted between the dumbbell inner cover 44 and the tailstock inner cover 42, wherein the scale gear 82 and the main gear 81 are meshed, and a back face of the scale gear 82 is provided with a gear scale 821, a scale window 445 is further provided on the dumbbell inner cover 44, two ends of a central shaft of the scale gear 82 extend outwards to form a mounting shaft 822, and a mounting hole 422 for inserting the mounting shaft 822 is provided between the dumbbell inner cover 44 and the tailstock inner cover 42 at a position corresponding to the mounting shaft 822, the gear scale 821 is marked with five gears, which respectively relate to 5 KG, 10 KG, 15 KG, 20 KG and 25 KG, and which respectively correspond to no dumbbell pieces loaded on both sides, one dumbbell piece loaded on both sides, two dumbbell pieces loaded on both sides, three dumbbell pieces loaded on both sides and four dumbbell pieces loaded on both sides. Since the main gear 81 is fixedly connected to the end of the handle tube 3, the main gear 81 can be driven to rotate when rotating the handle tube 3. The main gear 81 meshes with the scale gear 82, it can drive the scale gear 82 to rotate. The back face of the scale gear 82 is provided with a gear scale 821, and the gear scale 821 can be observed from the scale window 445 on the dumbbell inner cover 44, such that it is convenient for users to know the weight of dumbbells loaded by dumbbells in this case.

As shown in FIGS. 4-6, at least two pin holes 423 are symmetrically provided at an inner side of tailstock inner cover 42, positioning thimbles 47 are mounted inside the pin holes 423, thimble springs 48 are mounted between the positioning thimbles 47 and the pin holes 423, the plurality of pin holes 423 are located on the same circumference, a plurality of positioning holes 823 are uniformly distributed at an inner side of the scale gear 82, the diameter of the plurality of pin holes 423 is the same as that of the positioning holes 823, and when the gear scale 821 is directly in the position of the scale window 445, the positioning thimbles 47 can be inserted into the positioning hole 823, in the process of rotating the handle tube 3, whenever the positioning thimble 47 is pushed into the positioning hole 823, a dumbbell piece is just loaded or unloaded in this case, and the gear scale 821 is just at the scale window 445. This design can make the user get stuck and sound when just adjusting the specified weight when rotating the handle tube 3, and in this case, it has a certain sense of damping to prevent the user from paying attention to the scale display when rotating the handle tube 3.

As shown in FIG. 5, an outer wall of the tailstock body 41 is provided with a limiting ridge 412 for blocking two adjacent dumbbell pieces 2, the providing of the limiting ridge 412 can isolate two adjacent dumbbell pieces 2.

As shown in FIG. 4, slits 51 are provided at two ends of the fixed shaft 5, and a pin hole 491 is provided in the middle of the counterweight block 49, wherein the shapes of the pin hole 491 is matched with the slits 51, and the fixed shaft 5 is restricted from rotating by means of the cooperation of the slits 51 and the pin hole 491, the counterweight block 49 and the fixed shaft 5 are fixed by means of bolts.

Figure 7:
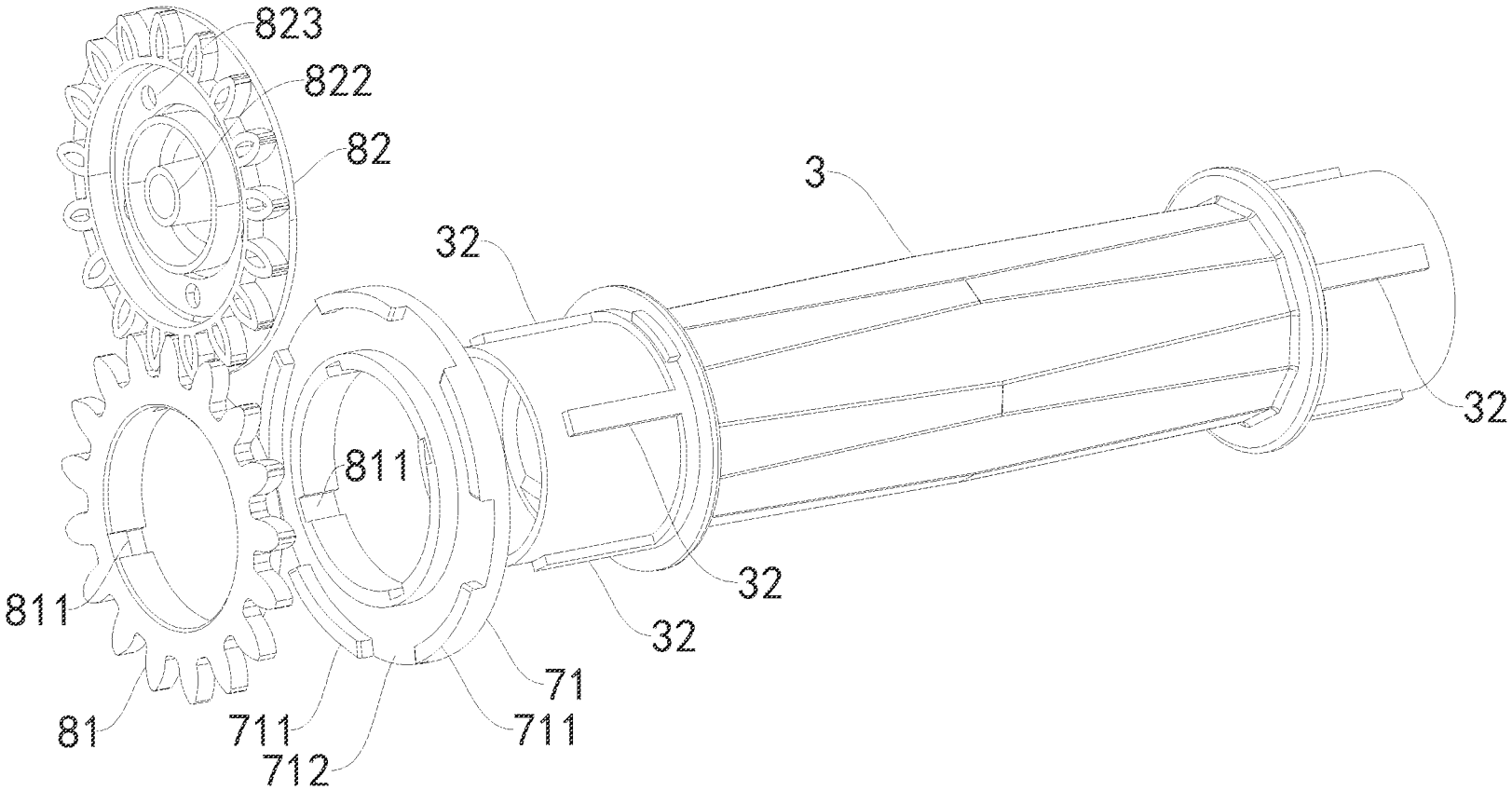
FIG. 7 is a schematic structural diagram of parts omitted in the present invention.
Figure 8:
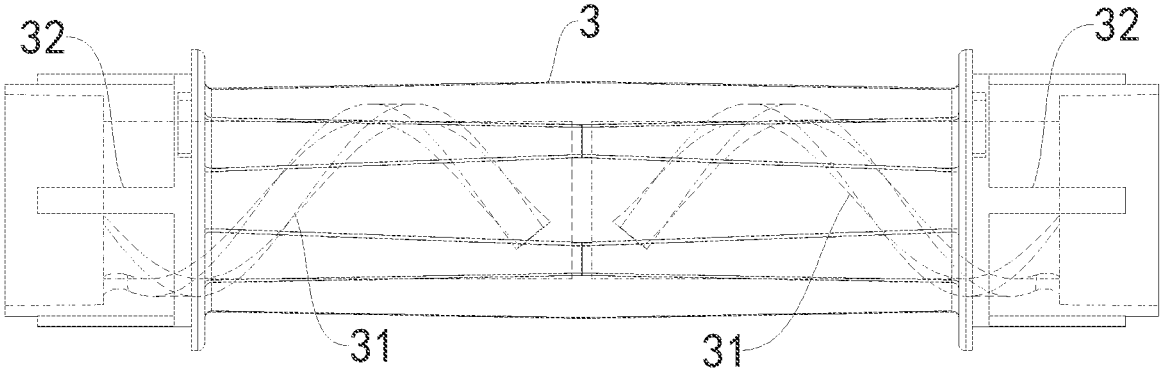
FIG. 8 is a schematic structural diagram of the handle tube of the present invention.
Figure 9:
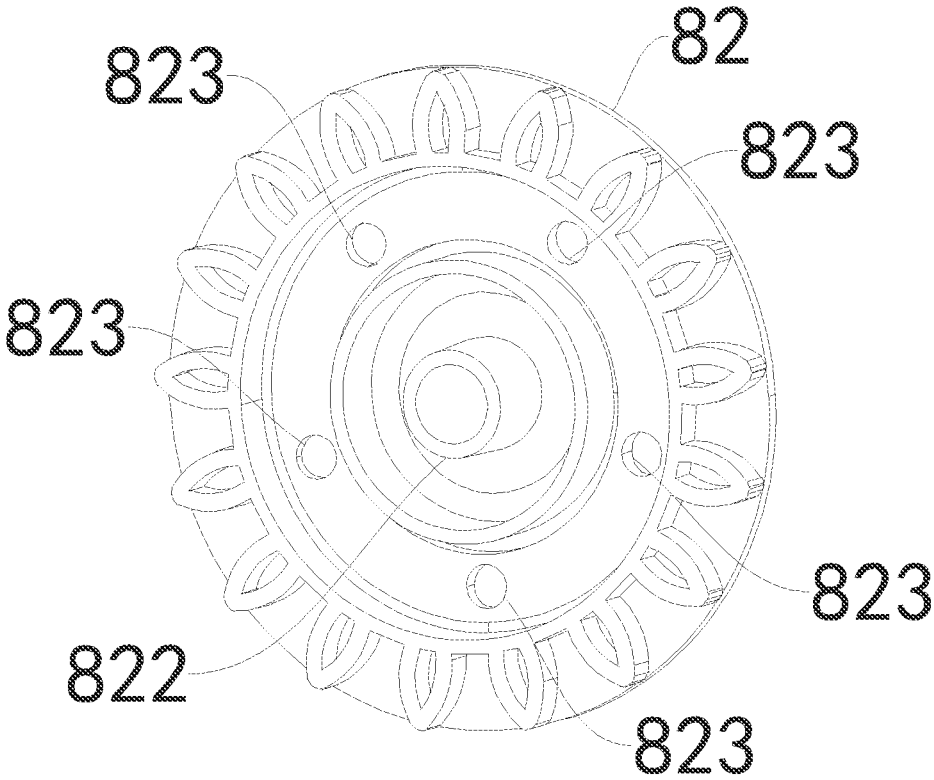
FIG. 9 is a schematic structural diagram of the scale gear of the present invention.

As shown in FIG. 7, a plurality of plug blocks 32 are uniformly provided at two ends of the handle tube 3, and slots 811 for inserting the plug blocks 32 are provided on inner rings of the limiting ring 71 and the main gear 81, such that the limiting ring 71 and the main gear 81 can rotate synchronously with the handle tube 3.

The working principle is: first, put the dumbbell assembly into the dumbbell seat 1, in this case, the limiting block 72 is jacked up by the pins 11 on the dumbbell seat 1. The hooking portion 721 of the limiting block 72 protrudes from the limiting block channel 712 of the limiting ring 71. The limiting ring 71 is in a rotatable state, such that the handle tube 3 is further in a rotatable state. When the handle tube 3 is rotated to make the two telescopic tubes 6 in the closest state, the gear scale displayed by the scale window 445 is 5 KG. Each dumbbell piece is in the dumbbell seat 1, the tailstock body 41 is on the top, and the dumbbell piece is clamped with the tailstock body 41 by means of the open groove 22. In this case, when the handle is took, the dumbbell piece is separated from the tailstock body 41, and the lifted dumbbell does not have the dumbbell pieces. Since the tailstock assembly 4 is further provided with the counterweight block 49, even if the dumbbell piece is not provided, the dumbbell can be lifted easily. When the handle is rotated, the telescopic tube extends out and penetrates into the fixing hole 21 of the dumbbell piece, and with the rotation in the same direction all the time, the telescopic tube penetrates from the first piece to the last dumbbell piece in sequence. In this process, the user can choose to rotate the handle and stop rotating according to the actual number of dumbbell pieces required. In this case, when the handle is took, the telescopic tube will be penetrated with the required number of dumbbell pieces. On the contrary, the dumbbell pieces can be unloaded by turning the handle in the reverse direction, and at the same time when the gear scale 821 is directly in the position of the scale window 445, the positioning thimbles 47 can be inserted into the positioning hole 823, in the process of rotating the handle tube 3, whenever the positioning thimble 47 is pushed into the positioning hole 823, a dumbbell piece is just loaded or unloaded in this case, and the gear scale 821 is just at the scale window 445. This design can make the user get stuck and sound when just adjusting the specified weight when rotating the handle tube 3, and in this case, it has a certain sense of damping to prevent the user from paying attention to the scale display when rotating the handle tube 3, when the dumbbell assembly is took, the limiting block 72 moves downward under the action of the locking spring 73, such that the hooking portion 721 of the limiting block 72 falls into the limiting block channel 712 of the limiting ring 71. In this case, the limiting ring 71 cannot rotate, such that the handle tube 3 cannot rotate either, thus preventing the dumbbell pieces from falling during in use. According to the invention, the dumbbell pieces can be loaded and unloaded only by rotating the handle, and the dumbbell pieces do not need to be moved additionally, so that the operation is convenient; the design of the limiting ring at the end of the handle, the limiting block below and the bolt on the base enables the dumbbell to rotate only when it is placed on the base; and when the dumbbell leaves the base, the hooking portion of the limiting block will block the limiting ring to prevent the handle from rotating, so that the safety is high. And the main gear is provided at the end of the handle at the same time, so when the handle rotates, the limiting ring, the main gear and the scale gear are linked together, and the scale dial can display the gear when the dumbbell pieces are loaded and unloaded.

In the embodiment of this application, the descriptions of directional nouns such as "front", "back", "left" and "right" are only described according to the directions shown in the drawings shown in this application, and are not limited to the scope of protection of the claims in this application. In the specific implementation process, other identical or similar embodiments can be obtained by making corresponding modifications according to this embodiment, all of which are within the scope of protection of this application, and for other similar or identical embodiments.

In the description of the present invention, it should be noted that the terms such as "mounted", "connected" and "connection" should be understood in broad sense, for example, can be fixed connection, detachable connection or integral connection; can be mechanically connected or electrically connected; can be directly connected, can further be indirectly connected by means of an intermediate medium, and interior communication of two elements can be used. The specific meanings of the above terms in the present invention may be understood by means of specific circumstances for a person of ordinary skill in the art.

Finally, it should be noted that the above content is only used to illustrate the technical solution of the present invention, not to limit the scope of protection of the present invention. Simple modification or equivalent replacement of the technical solution of the present invention by for a person of ordinary skill in the art will not depart from the essence and scope of the technical solution of the present invention.

What is claimed is:

1. A weight adjustable dumbbell, comprising;

a dumbbell assembly;

a dumbbell seat; and a plurality of dumbbell pieces placed on two sides of the dumbbell seat, wherein:

the dumbbell assembly comprises a handle tube;

two tailstock assemblies are respectively provided on two sides of the handle tube;

a fixed shaft is provided throughout inside the handle tube and the two tailstock assemblies, and two telescopic tubes are symmetrically sleeved outside the fixed shaft;

the handle tube is rotatably connected between the two tailstock assemblies;

the handle tube is a hollow tube piece, with an inner wall thereof being provided with two guide grooves with opposite screw directions;

one end of each of the two telescopic tubes close to a center of the handle tube is provided with a guide block, and an opposite end of each of the two telescopic tubes is symmetrically provided with an anti-rotation block;

each of the two tailstock assemblies comprises a tailstock body;

an anti-rotation groove is provided in each of the tailstock bodies;

the anti-rotation blocks are respectively installed in the anti-rotation grooves;

the guide blocks respectively mounted in the two guide grooves in a sliding manner, and rotating the handle tube is configured to drive the two telescopic tubes to slip in the anti-rotation grooves;

the plurality of dumbbell pieces are detachably mounted on the tailstock bodies;

a middle portion of each of the plurality of dumbbell pieces is provided with a fixing hole into which the two telescopic tubes are configured to be inserted, and an upper end of each fixing hole is provided with an open groove communicated therewith;

the width of each open groove is smaller than a diameter of the two telescopic tubes;

the width of each open groove is larger than a diameter of the fixed shaft;

with the forward or reverse rotation of the handle tube the guide blocks of each of the two telescopic tubes respectively travel along the two guide grooves;

the two telescopic tubes are configured to extend out or retract into the handle tube; and when the two telescopic tubes extend out of the handle tube and enter and respectively enter the tailstock bodies; the plurality of dumbbell pieces are configured to be loaded or unloaded in sequence with the rotation of the handle tube.

2. The weight adjustable dumbbell according to claim 1, wherein each of the two tailstock assemblies further comprises a tailstock inner cover and a tailstock outer cover, which are provided on two sides of the respective tailstock body, wherein a counterweight block is further mounted on each of the tailstock outer covers, wherein the counterweight block, the tailstock outer cover, the tailstock body, and the tailstock inner cover of each of the two tailstock assemblies are fixedly connected by means of long bolts, an outer side of each of the tailstock inner covers is clamped to a dumbbell inner cover, an outer side of each of the tailstock outer covers is clamped to a dumbbell outer cover, and an upper end of each of the tailstock bodies is clamped to an upper end cover.

3. The weight adjustable dumbbell according to claim 2, wherein the dumbbell assembly is further provided with two locking mechanisms, each of the two locking mechanisms comprises a limiting ring and a limiting block which are mounted between the dumbbell inner cover and the tailstock inner cover of a respective one of the two tailstock assemblies, wherein the limiting ring is sleeved at a respective end of the handle tube and is configured to provide, with the rotation of the handle tube, a plurality of limiting protruding bars at an outer edge of the limiting ring, wherein two adjacent limiting protruding bars do not come into contact with each other and form a limiting block channel, and a hooking portion protrudes from the top portion of the limiting block, wherein when the limiting block is initially affected by gravity, the hooking portion is located in the limiting block channel, so as to lock limiting protruding bars on two sides to limit the rotation of the handle tube relative to the respective tailstock assembly, and wherein after the limiting block is jacked up, the hooking portion separates from the limiting block channel.

4. The weight adjustable dumbbell according to claim 3, wherein a bottom of each of the dumbbell inner covers is provided with a pin hole and two front baffles are provided above the pin hole, each of the tailstock inner covers is provided with rear baffles at a position corresponding to the front baffles and a limiting groove for accommodating the respective limiting block is formed between the front baffles and the rear baffles, a supporting plate is further provided in each of the limiting grooves, one side of each of the limiting blocks is provided with two clamping blocks wherein an upper one of the two clamping blocks is above the respective supporting plate and a lower one of the two clamping blocks is below the respective supporting plate, and such that when the upper clamping block falls on the supporting plate, the hooking portion of the limiting block is located inside the limiting block channel, and a locking spring is further mounted between the lower clamping block and the supporting plate.

5. The weight adjustable dumbbell according to claim 4, wherein two pins are provided, in a protruding manner, on the dumbbell seat which respectively correspond to a bottom of each of the pin holes, such that when the dumbbell assembly is placed on the dumbbell seat, the two pins jack up each of the limiting blocks and make each of the hooking portions protruding from the top of each of the limiting blocks leave the respective limiting block channels.

6. The weight adjustable dumbbell according to claim 2, wherein the dumbbell assembly is further provided with a weight display mechanism, which comprises main gears fixedly mounted at ends of the handle tube and scale gears mounted between each of the dumbbell inner covers and each of the tailstock inner covers, wherein each of the scale gears and each of the main gears are respectively meshed, and a back face of each of the scale gears is provided with a gear scale, a scale window is further provided on each of the dumbbell inner covers, two ends of a central shaft of each of the scale gears extend outwards to form mounting shafts, and mounting holes for inserting the mounting shafts are provided between each of the dumbbell inner covers and each of the tailstock inner covers at a position corresponding to each of the mounting shafts.

7. The weight adjustable dumbbell according to claim 6, wherein each of the tailstock inner covers further comprises at least two pin holes symmetric ally provided at an inner side thereof, positioning thimbles are mounted inside the at least two pin holes, thimble springs are mounted between the positioning thimbles and the at least two pin holes, the at least two pin holes are located on the same circumference, a plurality of positioning holes are uniformly distributed at an inner side of the respective scale gear, a diameter of the at least two pin holes is the same as that of the plurality of positioning holes, and when the gear scale is directly in the position of the respective scale window, the positioning thimbles are configured to be inserted into the plurality of positioning holes.

8. The weight adjustable dumbbell according to claim 2, wherein slits are provided at two ends of the fixed shaft, and a pin hole is provided in the middle of each of the counter-weight blocks, wherein a shape of the pin holes is matched with the slits, and the fixed shaft is restricted from rotating by means of the cooperation of the slits and the pin holes.

9. The weight adjustable dumbbell according to claim 3, wherein a plurality of plug blocks are uniformly provided at two ends of the handle tube, and slots for inserting the plug blocks are provided on respective inner rings of the limiting rings and on respective main gears, such that the limiting rings and the main gears can are configured to rotate synchronously with the handle tube.

10. The weight adjustable dumbbell according to claim 1, wherein an outer wall of each of the tailstock bodies is provided with a limiting ridge for blocking two adjacent dumbbell pieces of the plurality of dumbbell pieces.

* * * * *